US005355139A

United States Patent [19]

Hirata et al.

[11] Patent Number: 5,355,139

[45] Date of Patent: Oct. 11, 1994

[54] MICROSTRIP ANTENNA SYSTEM

[75] Inventors: Toshikiyo Hirata; Yujiro Taguchi, both of Samukawa, Japan

[73] Assignee: Toyo Communication Equipment Co., Ltd., Kanagawa, Japan

[21] Appl. No.: 32,753

[22] Filed: Mar. 17, 1993

Related U.S. Application Data

[63] Continuation of Ser. 667,406, filed as PCT/JP90/00881 Jul. 9, 1990, abandoned.

[30] Foreign Application Priority Data

Sep. 8, 1989 [JP] Japan ..... 1-233856

[51] Int. Cl.[5] ..... H01Q 3/22; H01Q 3/02

[52] U.S. Cl. ..... 342/371; 342/374

[58] Field of Search ..... 342/374, 371, 370, 367, 342/368, 372; 343/700 MS, 705

[56] References Cited

U.S. PATENT DOCUMENTS

| | | | |
|---|---|---|---|
| 3,737,899 | 6/1973 | Georgopolous . | |
| 3,811,128 | 5/1974 | Munson et al. | 342/372 |
| 4,380,012 | 4/1983 | Bevan et al. | 343/705 |
| 4,667,201 | 5/1987 | Itoh . | |
| 4,766,438 | 8/1988 | Tang | 342/372 |
| 4,924,235 | 5/1990 | Fujisaka et al. . | |
| 5,281,974 | 1/1994 | Kuramoto et al. | 343/700 MS |

FOREIGN PATENT DOCUMENTS 0052660 1/1977 Japan .

*Primary Examiner*—Gregory C. Issing
*Attorney, Agent, or Firm*—Graham & James

[57] ABSTRACT

When a beam is formed in a direction at a switching point of microstrip array panels, two microstrip array panels associated with the switching point are used and a phase shift due to arrangement of the panels is compensated by a pre-set phase shifter so that sufficient gains can be secured for omni directions including boundary directions of the array panels in which very small gains have been obtained previously.

4 Claims, 7 Drawing Sheets

MICROSTRIP ANTENNA SYSTEM

This is a continuation of copending application Ser. No. 07/667,406 filed as PCT/JP90/00881, Jul. 9, 1990, now abandoned.

TECHNICAL FIELD

The present invention relates to a microstrip antenna system capable of having an antenna gain which is uniform in omni directions.

BACKGROUND OF THE INVENTION

As a communication system which is mounted on an airplane or a land mobile vehicle, a communication system in which an artificial satellite is used as a relaying station has been studied, and a microstrip antenna is supposed to be a prospective antenna which will be used therein because of having advantages such as small size and light weight.

FIG. 9 is a perspective view showing a microstrip antenna which is used in the communication system.

The microstrip antenna shown in FIG. 9 is mounted and used, for example on a body of an airplane, and includes a fairing 102 and two microstrip array panels 104 and 105. The fairing (radome) 102 in which a frame 103 is disposed is fitted on to a base 101. The two microstrip array panels 104 and 105 are mounted on this frame 103.

Each of the microstrip array panels 104 and 105 is provided with a base plate 106 made of low dielectric, a gland surface 107 formed on the reverse side of the base plate 106, and a plurality of driver elements 108 formed on the surface of the base plate 106.

And, a phase in a signal supplied to each of the driver elements 108 or in a signal received by each of the driver element 108 is shifted to a given degree by a phase shifter which is not shown in the drawing. Therefore, each area to which each microstrip array panel faces at an angle of 180° is scanned in directivity, and an omni directional communication is made possible by the two microstrip array panels which are in both of the right and left sides.

However, in the microstrip antenna in which the two array panels are placed back to back, as shown in FIG. 10, in a range of a small scanning angle from an imaginable plane perpendicular to the microstrip array panel 104 or 105, a sufficient gain is obtained whereas in a range of a large scanning angle from the imaginable plane perpendicular to the microstrip array panel 104 or 105, a sufficient gain is not secured. Therefore, there is a disadvantage such that a communication in that direction becomes difficult.

Accordingly, it is an object of the present invention to provide a microstrip antenna capable of solving the disadvantage as described above as well as of securing sufficient gains in omni directions.

DISCLOSURE OF THE INVENTION

In order to achieve the object described above, in a microstrip antenna according to the present invention, these are provided a plurality of microstrip array panels disposed in response to at least 4 directions, namely, front, rear, right and left, and also a selecting circuit for selecting and operating anyone or a plurality of these microstrip array panels.

Consequently, in accordance with the present invention it is possible to secure an antenna gain which is substantially uniform and sufficient in omni directions.

BEST MODE FOR EMBODYING THE INVENTION

Figure 1:
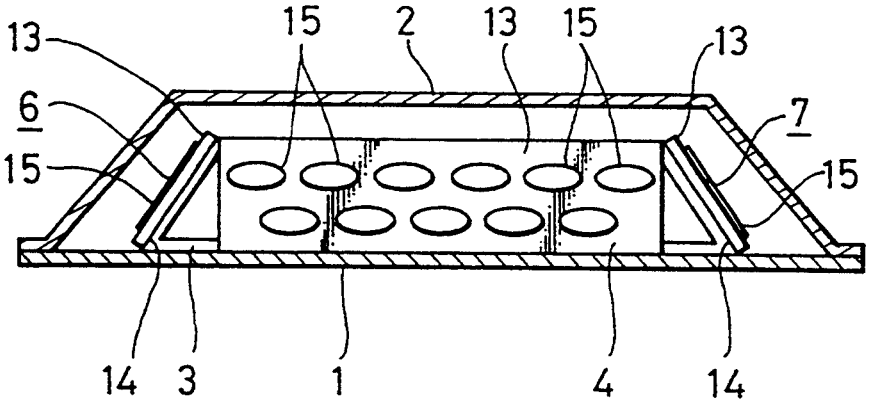
FIG. 1 is a side view showing an embodiment of a microstrip antenna system in accordance with the present invention.

Herein below, the present invention will be described in details referring to the drawings.

Figure 2:
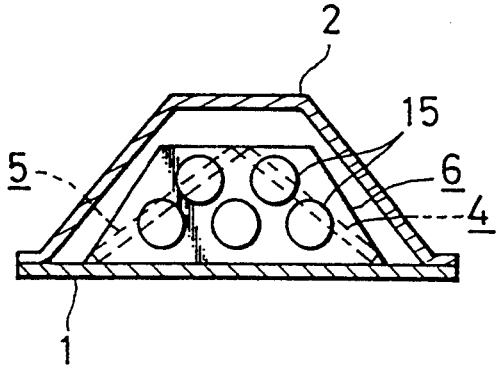
FIG. 2 is a front view of the microstrip antenna system shown in FIG. 1.

FIG. 1 is a side view showing an embodiment in accordance with the present invention and FIG. 2 is a front view of the embodiment.

A base 1 is attached to an upper surface of a body of, for example an airplane and a fairing 2 is mounted on the base 1. A microstrip antenna includes a frame 3, and four microstrip array antenna panels, 4, 5, 6, and 7, and stored in the space between the upper surface of the base 1 and the under surface of the fairing 2.

Figure 3:
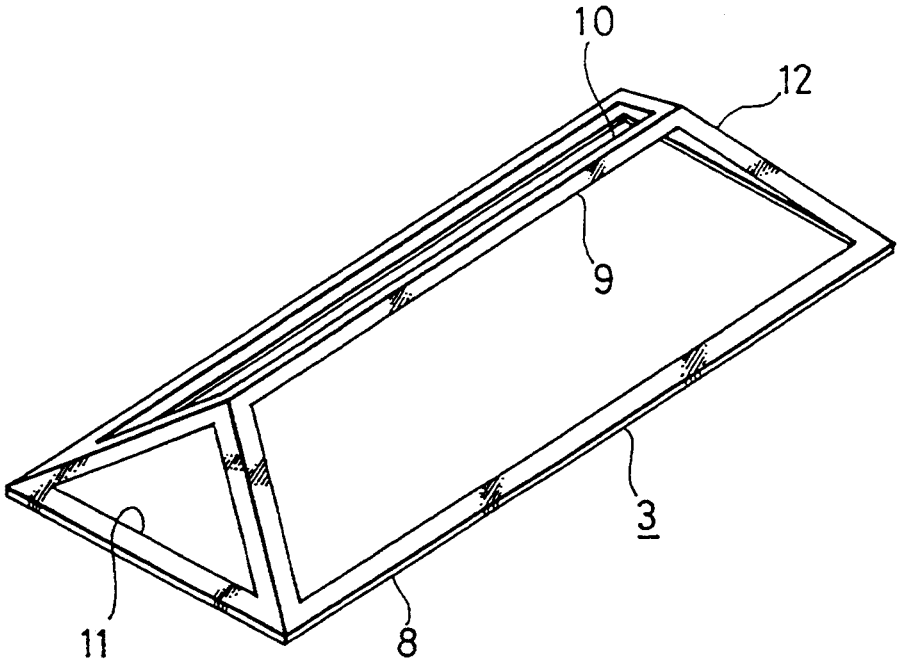
FIG. 3 is a detailed perspective view of the frame shown in FIG. 1.

As shown in FIG. 3, the frame 3 includes a bottom frame 8 which is fixed on the upper surface of the base 1 described above, and mounting frames 9–12 protruding obliquely and upwardly from the bottom frame 8. And microstrip array panels 4–7 are installed and fixed onto the mounting frames 9–12 respectively. Further, each one of the mounting frames 9 and 10, which is located along the longitudinal direction of the bottom frame 8, is formed a trapezoid, and each one of the mounting frames 11 and 12, which is located along the traverse direction of the bottom frame 8, is formed a triangle.

Figure 4:
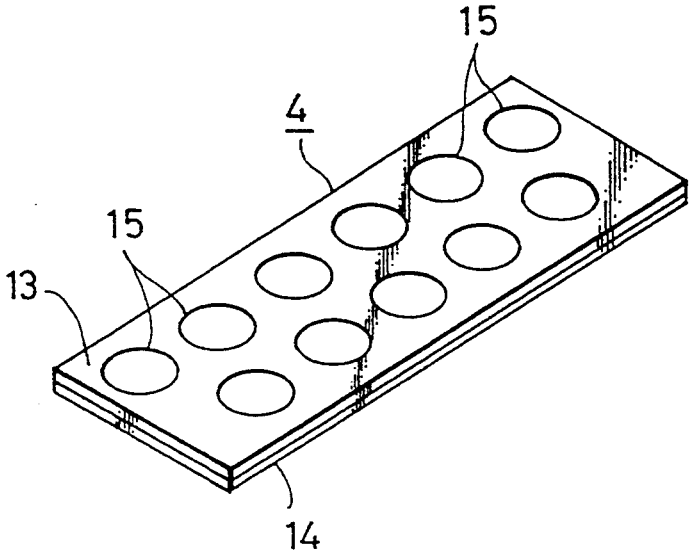
FIG. 4 is a detailed perspective view of the microstrip array panel shown in FIG. 1.

Each of the microstrip array panels 4, 5, 6, and 7 includes a substrate 13 made of low dielectric substance, a ground surface 14 formed on the reverse side of the substrate 13, and a plurality of driver elements 15 formed on the top surface of the substrate 13 as shown in FIG. 4.

The front and rear microstrip array panels 6 and 7 are different in the panel areas and the number of driver elements from the side microstrip array panels 4 and 5. And these microstrip array panels are arranged as inclined in four directions in a similar way to a roof of a house as shown in FIGS. 1 and 2.

Figure 5:
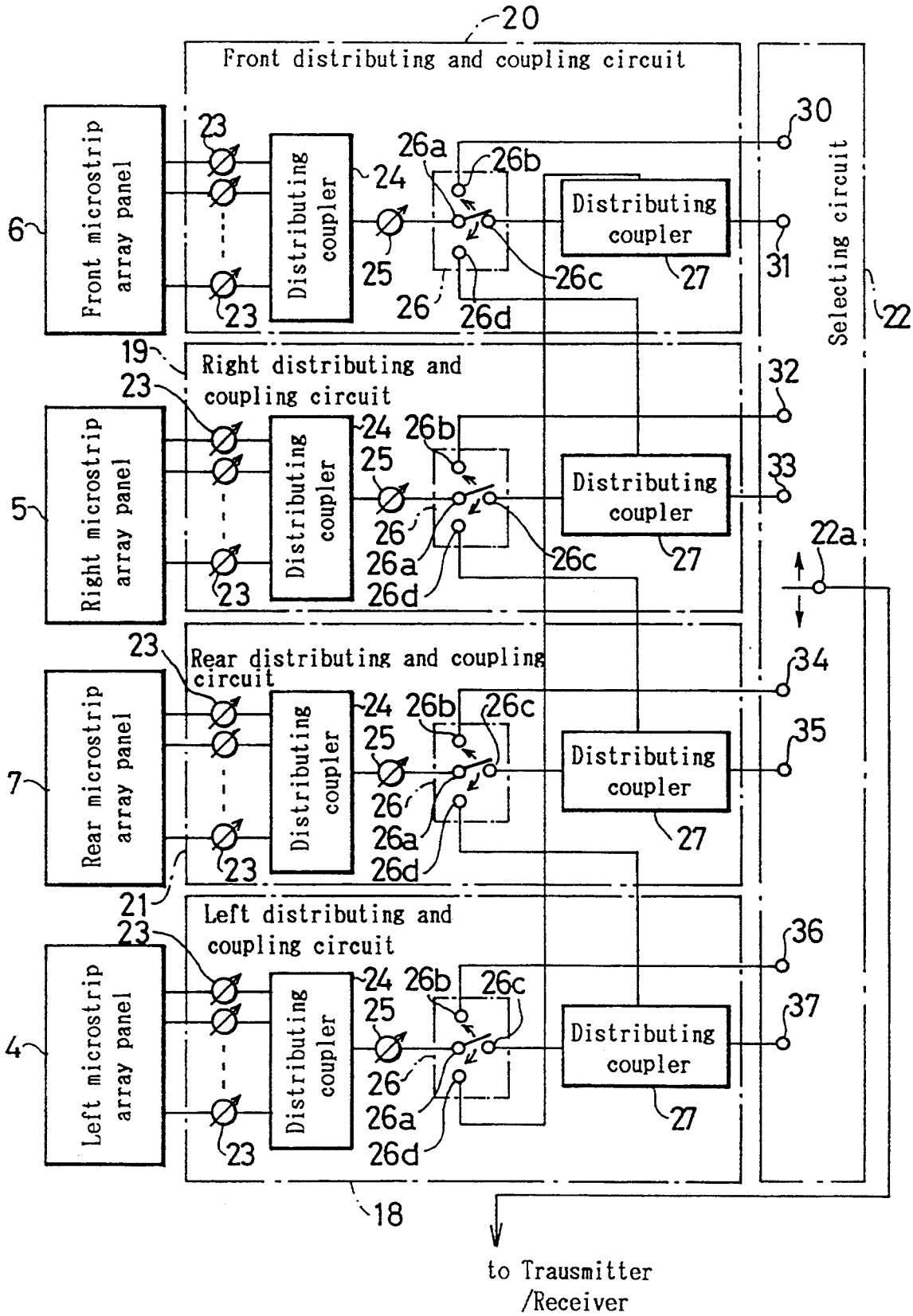
FIG. 5 is a block diagram showing a circuit of the embodiment.

Each of the driver elements 15 and the gland surfaces 14 of microstrip array panels 4–7 is connected to a distributing and coupling circuit as shown in FIG. 5.

The distributing and coupling circuit shown in the figure includes a left distributing and coupling circuit 18, a right distributing and coupling circuit 19, a front distributing and coupling circuit 20, and a rear distributing and coupling circuit 21 corresponding to the microstrip array panels 4–7 respectively, and they are connected to a transmitter/receiver, not shown in the figure, via a selecting circuit 22.

Each of the distributing and coupling circuits 18–21 includes a plurality of phase shifters 23 connected to the driver elements on one of the microstrip array panels respectively, a distributing coupler 24 connected to the phase shifters 23, a pre-set phase shifter 25 which adjust phase shifts of I/O signals in the distributing coupler 24, a change over switch 26 connected to the pre-set phase shifter 25, and a distributing coupler 27 connected to the change over switch 26 and the selecting circuit 22. Each of the phase shifters 23 is constructed to control directivity of the antenna as a whole by regulating the phases of I/O transmitting and receiving signals from or to the driver elements on the microstrip array panel. Namely, when a plurality of transmitting signals are supplied from the distributing couplers 24 to the phase shifters 23, the shifters regulate the phases of them and supply them to the driver elements 15, and regulate the phases of receiving signals from the driver elements 15 and supply them to the distributing couplers 24.

When transmitting signals are supplied from the pre-set phase shifters 25 to the distributing couplers 24, the couplers 24 distribute them to each of the phase shifters 23, and when receiving signals are supplied from the respective phase shifter 23 to the couplers 24, the couplers 24 couple and supply them as a single receiving signal to the respective pre-set phase shifters 25.

Figure 7:
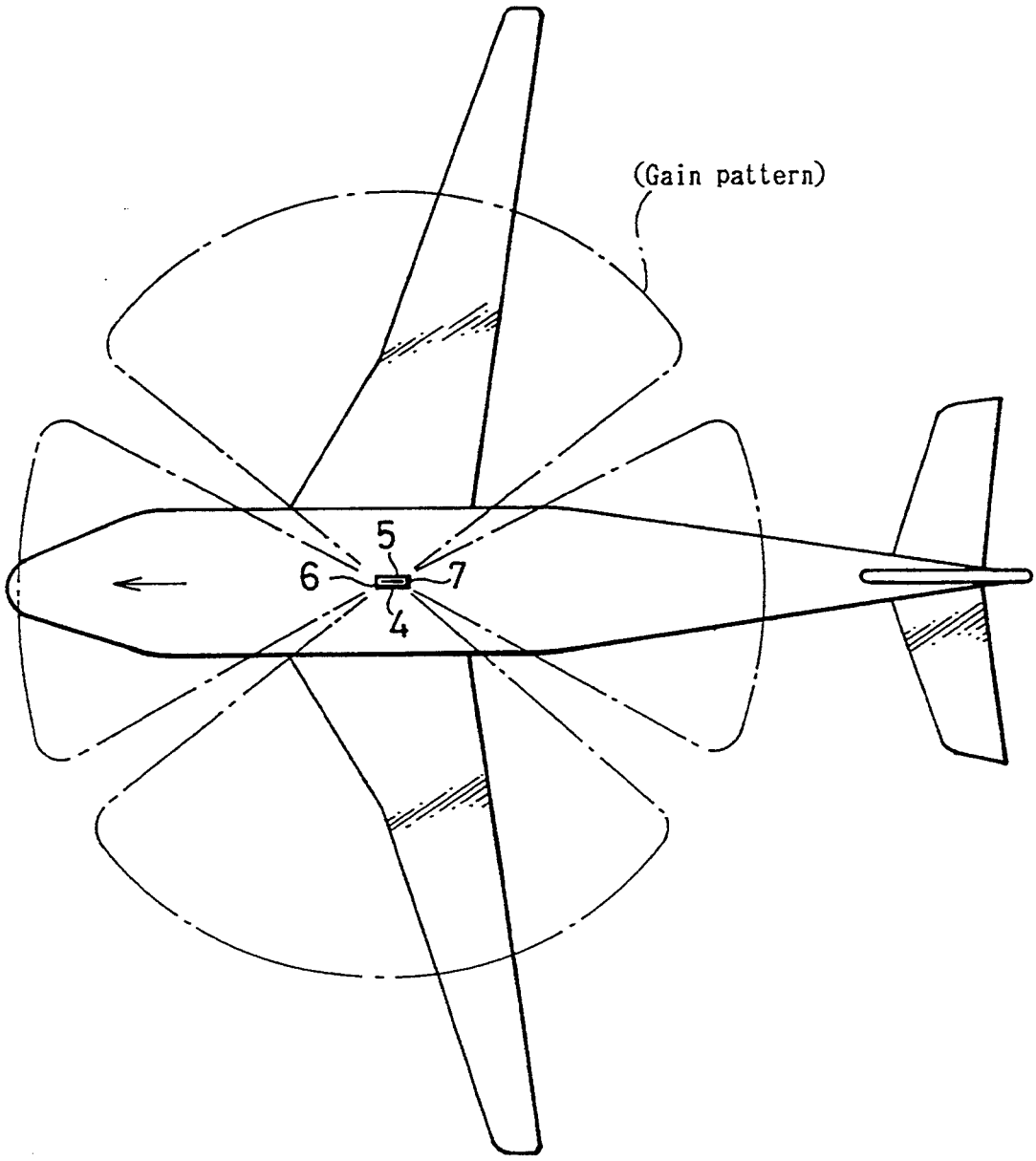
FIG. 7 is a schematic view for illustrating a radial characteristics of the embodiment.

In this embodiment, a directional scanning is performed from side to side as centered with respect to a mutual rectangular direction by using the respective microstrip antenna, and in a boundary portion between the scanning areas of the antennas, that is, in diagonal directions at vertical angles from the rectangle located in the center in a plane as shown in FIG. 7, a scanning is performed by using the adjacent antennas with each other and combining directional characteristics of both of the adjacent antennas.

The pre-set phase shifter 25 is constructed to compensate a lag in phase between these antennas due to the difference in the directions of both of these antennas. Namely, the pre-set phase shifter 25 is constructed to regulate phases between a microstrip array panel and the microstrip array panel adjacent to the above one (for example the array 6 adjacent to the array 4 or 5) such that when the signals which are received by the respective driver elements 15 on the microstrip array panels are combined, a reduction in the gain due to the lag in phase is prevented. When transmitting signals are supplied from the change over switch 26 to the preset phase shifter 25, the phases in the transmitting signals are shifted and supplied to the distributing coupler 24, and when the receiving signals are supplied from the distributing coupler 24 the phases in the receiving signals are shifted and supplied to the change over switch 26.

The change over switch 26 includes a common terminal **26*a* connected to the pre-set phase shifter 25, a terminal 26*b* connected to the selecting circuit 22, a terminal 26*c* connected to for example the distributing coupler 27 in the front distributing and coupling circuit 20, and a terminal 26*d* connected to the distributing coupler 27 in the right distributing and coupling circuit 19. And the common terminal 26*a* is connected to any one of the terminals 26*b*–26*d*** in response to the direction of the directivity of the antenna.

Also, the distributing coupler 27 is constructed to distribute and couple the transmitting and receiving signals when the directivity is pointed toward the direction adjacent to two microstrip array panels described above and to combine and distribute the I/O signals of the array panels adjacent to each other.

And, the selecting circuit 22 includes a common terminal **22*a* connected to the transmitter/receiver, front selecting terminals 30, 32, 34, and 36 connected to the change over switches 26 of the left, right, front and rear distributing and coupling circuits 18–21, and selecting terminals 31, 33, 35, and 37 connected to the distributing couplers 27. And the common terminal 22*a* is connected to any one of the terminals 30–37** in response to the directivity.

Figure 8:
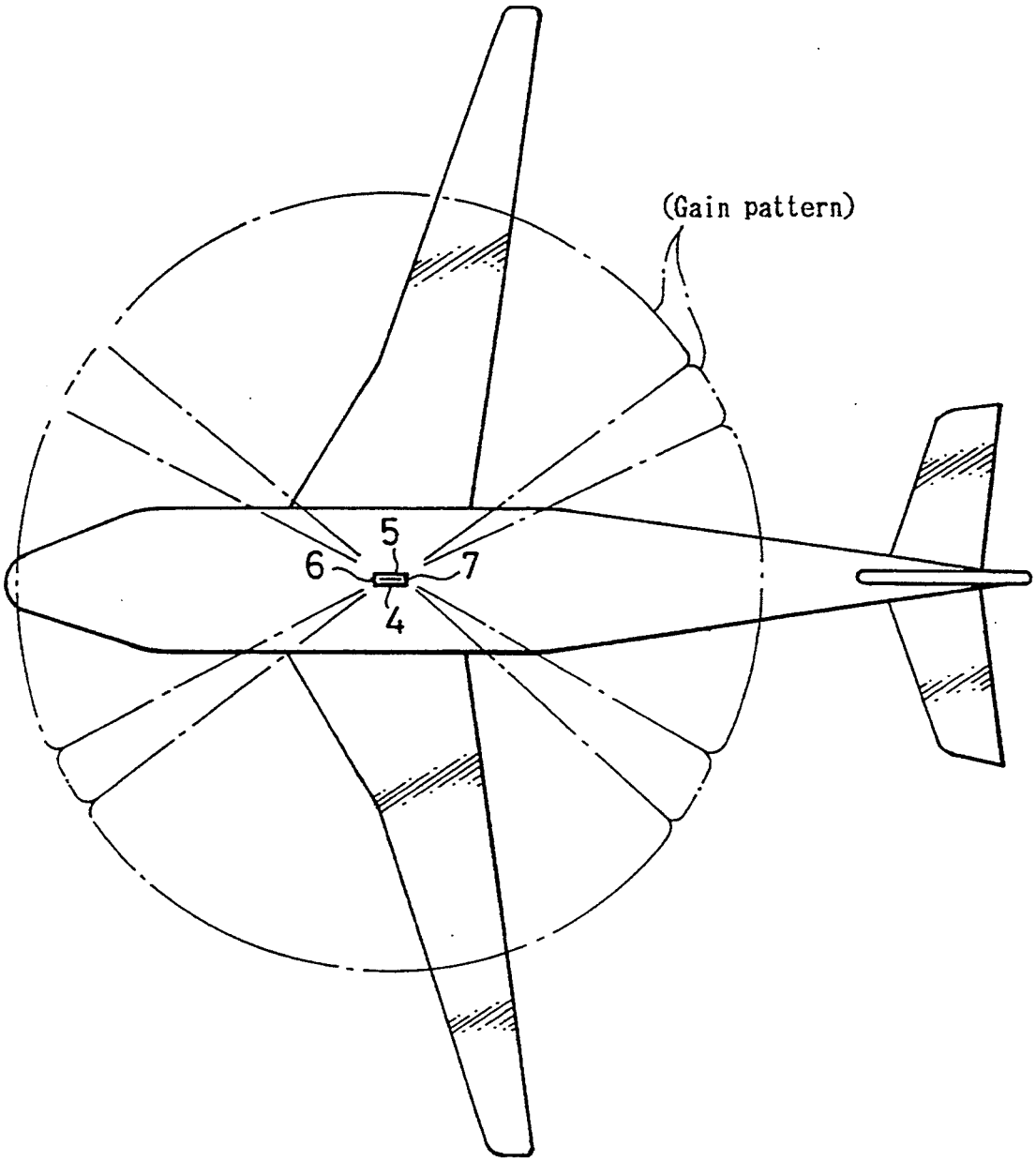
FIG. 8 is a schematic view for illustrating a radial characteristics diagram of the embodiment.
Figure 9:
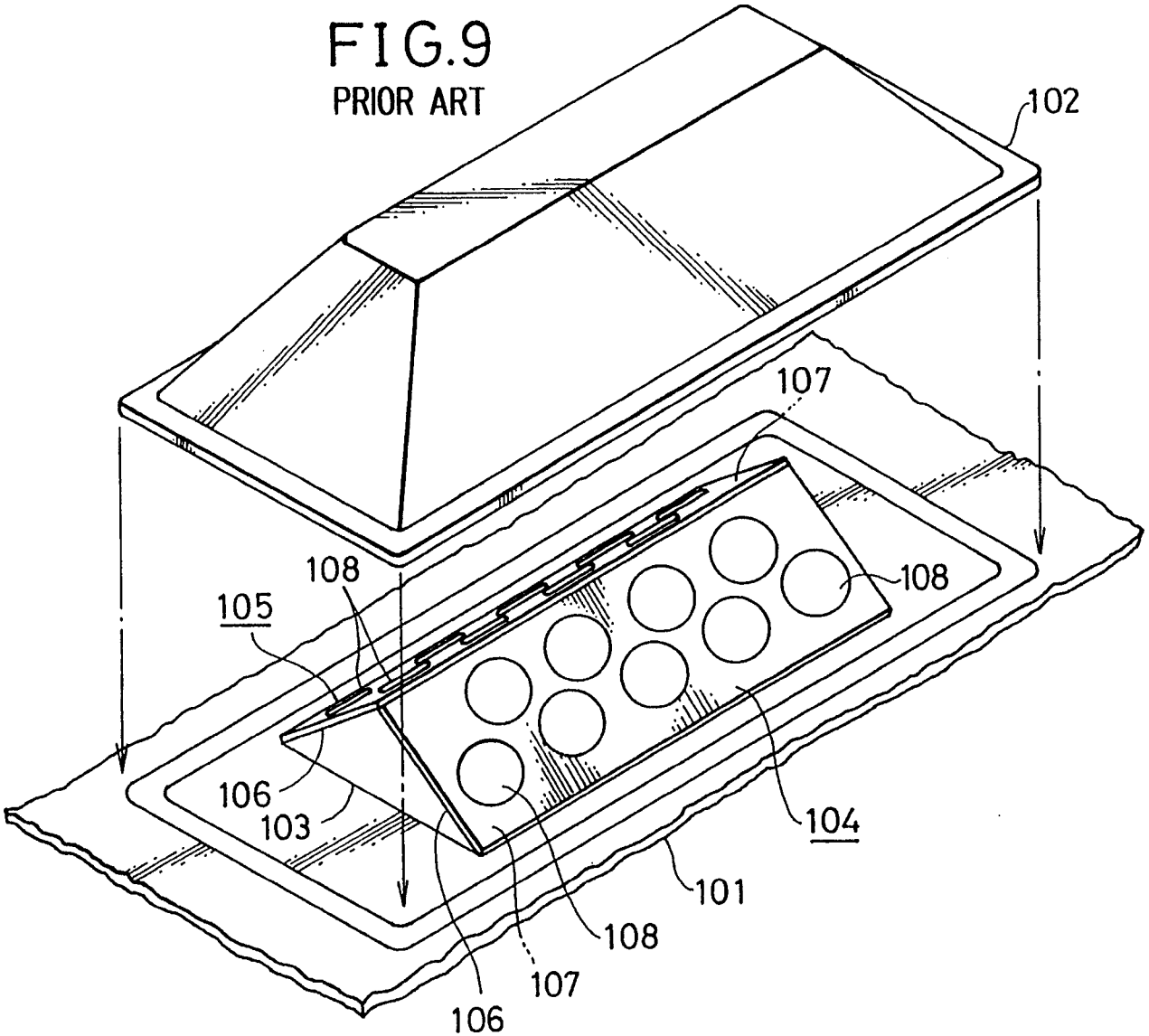
FIG.9 PRIOR ART
FIG. 9 is a perspective view showing a previously known microstrip antenna.
Figure 10:
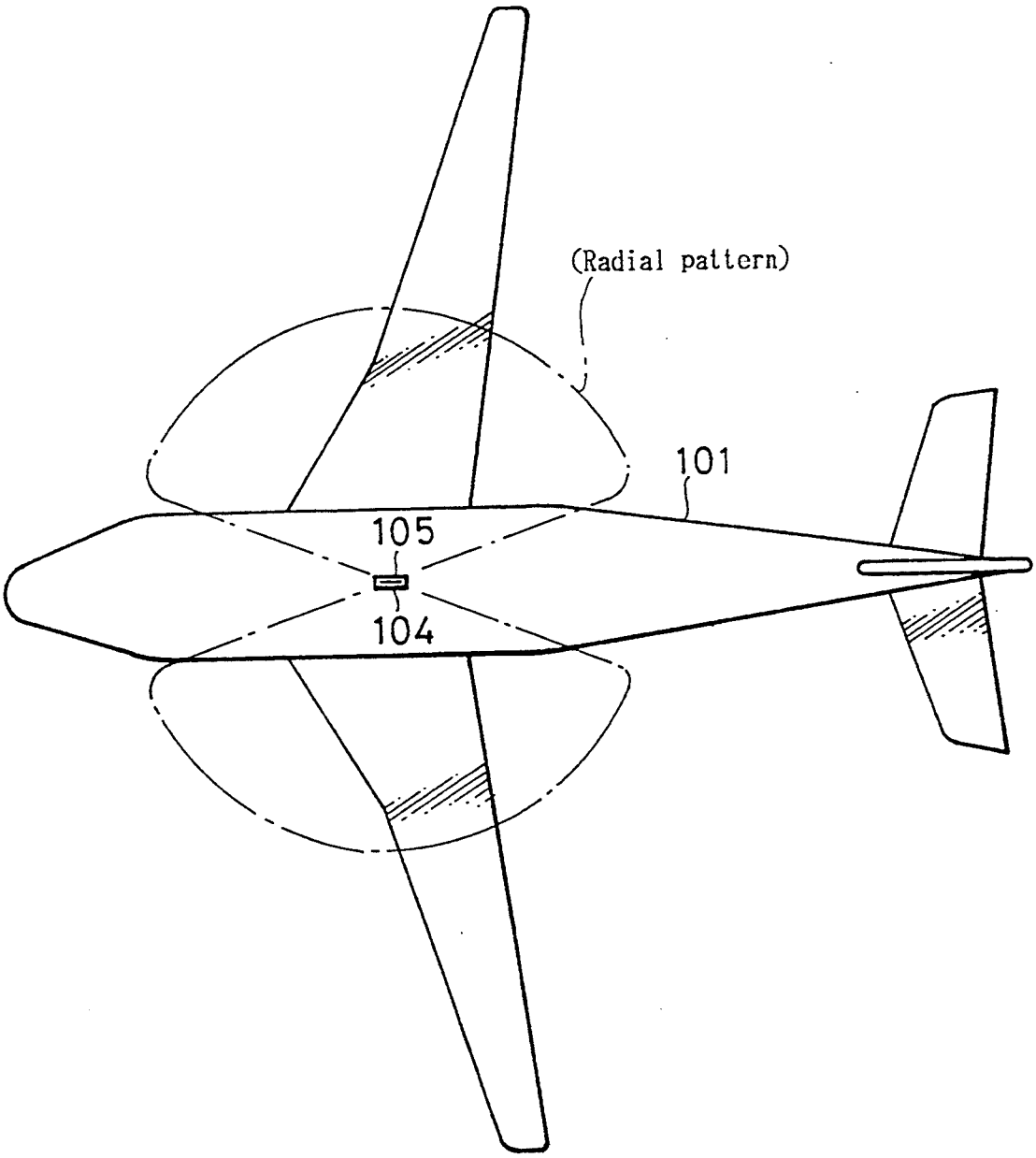
FIG.10 PRIOR ART
FIG. 10 is a schematic view for illustrating the characteristics of the microstrip antenna shown in FIG. 9.

Next, an operation principle and practically specific operation of this embodiment will be described referring to FIGS. 6 to 8.

Figure 6:
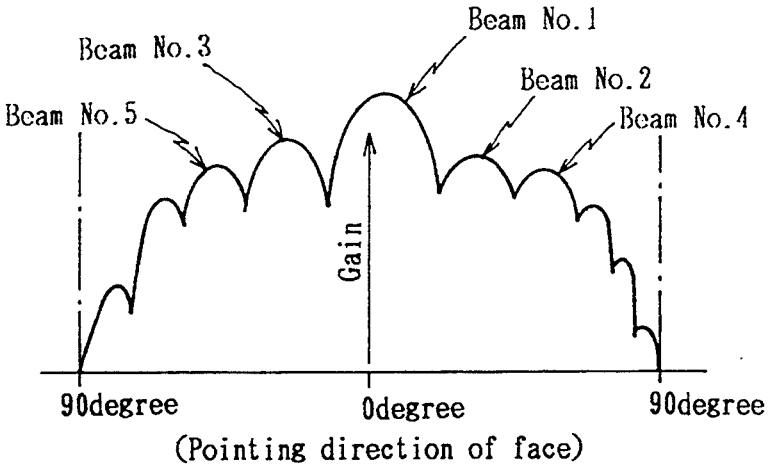
FIG. 6 is a radial characteristics diagram of a microstrip array panel used in the embodiment.

First, in the microstrip array panels 4–7, as shown in beam scanning characteristics in FIG. 6, there are the largest gains in the directions extending to portions over the respective driver elements 15 and smaller gains in the directions being at right angles to those directions (crosswise directions) as beam scanning characteristics.

Therefore, in the case where any of the microstrip array panels 4–7 is selectively used, gains in the directions between the neighboring microstrip array panels (hereinafter referred to as switching points), are reduced.

Thus, in this embodiment, for the areas in the directions at the switching points, there are drived the two microstrip array panels at each of the areas, for example, the microstrip array panels 5 and 6 associated with the right and front areas, the microstrip array panels 5 and 7 associated with the right and rear areas, the microstrip array panels 4 and 7 associated with the left and rear area, and the microstrip array panels 4 and 6 associated with the left and front. Namely two combined antenna arrays are used and cooperated, as shown in FIG. 8 so that a reduction in the gains is compensated for in these areas.

As given below, the specific operation in accordance with the present embodiment mentioned above will be concretely described.

In the case where any one direction, for example, a right side direction is selected so that signals are transmitted and received in that direction, then a switch within the selecting circuit 22 is so changed that the common terminal **22*a* is connected to the right selecting terminal 32 and also the change over switch 26 in the right distributing and coupling circuit 19 is so changed that the common terminal 26*a* is connected to the terminal 26*b***.

And at this time, the phases in the respective phase shifters 23 within a right distributing and coupling circuit 19 are regulated in response to the pointed direction.

Accordingly, through the selecting circuit 22, the change over switch 26, the pre-set phase shifter 25, the distributing coupler 24, and the respective phase shifters 23 in the right distributing and coupling circuit 19, a transmitter/receiver is connected to the respective driver elements 15 on the microstrip array panel 5.

And, in the case of transmitting and receiving in the direction at the switching point of the microstrip array panels 5 and 6 (forward and rightward) a switch within the selecting circuit 22 is so changed that the common terminal **22*a* is connected to the right front selecting terminal 33, the switch 26 in the right distributing and coupling circuit 19 is so changed that the common terminal 26*a* is connected to the terminal 26*c*, and the switch 26 in the front distributing and coupling circuit 20 is so changed that the common terminal 26***a* is connected to the terminal 26*d*.

And at this time, the phases in the respective phase shifters 23 within the right distributing and coupling circuit 19 and the phases in the respective phase shifters 23 within the front distributing and coupling circuit 20 are regulated in response to a communicating direction.

Accordingly, in the case of transmitting, transmitter/receiver input signals are supplied via the selecting circuit 22 to the distributing coupler 27 of the right distributing and coupling circuit 19 wherein they are divided into two signals. And one of the divided transmitting signals is supplied to the respective driver elements 15 on the microstrip array panel 6 through the switch 26, the pre-set phase shifters 25, the distributing coupler 24, and the phase shifters 23 in the front distributing and coupling circuit 20.

Also, the other transmitting signal divided by the distributing coupler 27 in the right distributing and coupling circuit 19 is supplied to the respective driver elements 15 on the microstrip array panel 5 through the switch 26, the pre-set phase shifter 25, the distributing coupler 24 and the phase shifters 23 in the same block 19.

Thus, a radiowave is emitted from each of the driver elements 15 on the microstrip array panels 5 and 6 and as a result a directivity is determined by both of the controlling phases.

And, the receiving operation in this condition is opposite to the case of the transmitting described above. Namely, signals received by the microstrip array panels 5 and 6 are coupled in the distributing coupler 27 in the right distributing and coupling circuit 19 and supplied to the transmitter/receiver (not shown in the drawing) through the selecting circuit 22.

In this embodiment, when a beam is formed in the direction at the switching point of the microstrip array panels 4–7, two microstrip array panels associated with this switching point are used and a lag in phase due to the arrangement of the panels is compensated by the pre-set phase shifter 25 so that sufficient gains can be secured for omni directions including boundary directions of the array panels in which very small gains have been obtained previously.

Also, in the embodiment described above, four pre-set phase shifters 25 are used to compensate the phases in the transmitting and receiving signals for the microstrip array panels 4–7, but a variable phase shifter may be used in place of the pre-set phase shifter 25 to control finely phases in response to a communicating direction so that the most appropriate value may be obtained.

With a view to this it will be effective to perform control by a CPU.

INDUSTRIAL APPLICABILITY

As described above, sufficient gains can be secured for omni directions in accordance with the present invention, since two or more antennas adjacent to each other cooperate to cover an area which cannot be covered by a microstrip array antenna.

We claim:

1. A microstrip antenna system used for mobile communications comprising:

four microstrip array panels provided on a body of a mobile and directed ninety degrees from each other in the azimuthal direction, said four microstrip array panels being inclined so that each of said four microstrip array panels faces upward;

four distributing and coupling circuits connected to said microstrip array panels, respectively, said distributing and coupling circuits comprising a switching means, a plurality of phase shifters and distributing couplers;

a plurality of driver elements provided on each of said microstrip array panels; each of said driver elements being connected to each one of said phase shifters; and a selecting circuit having a plurality of terminals which are connected to said distributing and coupling circuits, said selecting circuit selecting any one of said terminals wherein said selecting circuit selecting a terminal so that two microstrip array panels, which are adjacent to each other, are associated and cooperated in order to increase a gain when a signal is transmitted to or received from a boundary direction of the selected two microstrip array panels.

2. A microstrip antenna system for transmitting or receiving signals, having:

four microstrip array panels disposed in directions corresponding to the front, rear, left and right of the antenna system;

a plurality of driver circuits provided on each of the panels;

a selecting circuit for simultaneously selecting adjacent microstrip array panels for reception or transmission of the signals;

a plurality of first phase shifters provided for each of the four panels for regulating phase of the signals; and four second phase shifters connected to the first phase shifters and disposed correspondingly to the four panels for regulating the relative phase of signals corresponding to different panels so that a lag in phase between the adjacent panels decreases.

3. A microstrip antenna system as claimed in claim 2, wherein the second phase shifters are pre-set to provide a fixed phase shift.

4. A microstrip antenna system as claimed in claim 2, wherein the second phase shifters are variable to provide a variable phase shift.

* * * * *